US010892151B2

(12) United States Patent
Richardson et al.

(10) Patent No.: US 10,892,151 B2
(45) Date of Patent: Jan. 12, 2021

(54) LOCK MASS LIBRARY FOR INTERNAL CORRECTION

(71) Applicant: Micromass UK Limited, Wilmslow (GB)

(72) Inventors: Keith Richardson, High Peak (GB); Steven Derek Pringle, Darwen (GB); Michael Raymond Morris, Hadfield Glossop (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 15/578,990

(22) PCT Filed: Jun. 1, 2016

(86) PCT No.: PCT/GB2016/051605
§ 371 (c)(1),
(2) Date: Dec. 1, 2017

(87) PCT Pub. No.: WO2016/193721
PCT Pub. Date: Dec. 8, 2016

(65) Prior Publication Data

US 2018/0144916 A1 May 24, 2018

(30) Foreign Application Priority Data

Jun. 1, 2015 (GB) ..... 1509402.2

(51) Int. Cl.
*H01J 49/00* (2006.01)

(52) U.S. Cl.
CPC ..... *H01J 49/0009* (2013.01); *H01J 49/0036* (2013.01); *H01J 49/0004* (2013.01)

(58) Field of Classification Search
CPC . H01J 49/0004; H01J 49/0009; H01J 49/0036
See application file for complete search history.

(56) References Cited

U.S. PATENT DOCUMENTS 6,960,761 B2 * 11/2005 Clemmer ..... G01N 27/622 250/287
7,095,014 B2 * 8/2006 Hoyes ..... H01J 49/004 250/281

(Continued)

FOREIGN PATENT DOCUMENTS

CN 103918055 A 7/2014
WO 2013/081581 A1 6/2013

(Continued)

OTHER PUBLICATIONS

Genotype versus phenotype—https://evolution.berkeley.edu/evolibrary/article/genovspheno_01 (Year: 2007).*

(Continued)

*Primary Examiner* — Nicole M Ippolito
*Assistant Examiner* — Sean M Luck
(74) *Attorney, Agent, or Firm* — Kacvinsky Daisak Bluni PLLC

(57) ABSTRACT

A method of calibrating or optimising an analytical instrument is disclosed that comprises analysing analyte from a sample using an analytical instrument, determining a sample type of the sample based on analysis of analyte from the sample, identifying one or more species of the analyte that are known to be endogenous to the determined sample type, and calibrating or optimising the analytical instrument using the one or more identified endogenous species.

18 Claims, 3 Drawing Sheets

(56) References Cited

U.S. PATENT DOCUMENTS 7,586,088 B2 * 9/2009 Bateman ..... H01J 49/004 250/281
8,785,848 B2 * 7/2014 Wu ..... G01N 27/622 250/281
8,921,772 B2 * 12/2014 Verenchikov ..... G01N 27/622 250/281
2005/0092910 A1 * 5/2005 Geromanos ..... C12Q 1/6872 250/282
2005/0189486 A1 * 9/2005 Fuhrer ..... G01N 27/622 250/287
2008/0070314 A1 * 3/2008 Geromanos ..... G01N 33/6848 436/86
2008/0201095 A1 8/2008 Yip et al.
2009/0065687 A1 3/2009 Gross
2010/0029005 A1 * 2/2010 Kamiie ..... G01N 30/7266 436/86
2010/0108879 A1 * 5/2010 Bateman ..... G01N 27/622 250/283
2011/0282587 A1 * 11/2011 Jones ..... G16B 5/00 702/19
2015/0041636 A1 * 2/2015 Giles ..... H01J 49/004 250/282

FOREIGN PATENT DOCUMENTS

WO 2014/085938 A1 6/2014
WO 2014/194320 A1 12/2014

OTHER PUBLICATIONS

H. R. Liang, et al., "Quantitative determination of endogenous sorbitol and fructose in human nerve tissues by atmospheric-pressure chemical ionization liquid chromatography tandem mass spectrometry", Rappid Communications in Mass Spectrometry, 19(16):2284-2294, Aug. 30, 2005.
Search Report for GB15094022 dated Mar. 1, 2016.
International Search Report and Written Opinion for PCT/GB2016/051605 dated Sep. 15, 2016.

* cited by examiner

LOCK MASS LIBRARY FOR INTERNAL CORRECTION

CROSS-REFERENCE TO RELATED APPLICATION

This application is a national phase filing claiming the benefit of and priority to International Patent Application No. PCT/GB2016/051605, filed on Jun. 1, 2016, which claims priority from and the benefit of United Kingdom patent application No. 1509402.2 filed on Jun. 1, 2015. The entire contents of which are incorporated herein by reference.

FIELD OF THE INVENTION

The present invention relates generally to methods of mass and/or ion mobility spectrometry and mass and/or ion mobility spectrometers, and in particular to methods of calibrating or optimising mass and/or ion mobility spectrometers and control systems for calibrating or optimising a mass and/or ion mobility spectrometer.

BACKGROUND

It is known to calibrate a mass spectrometer by, for example, analysing a mixture of molecular species having known mass to charge ratio values ("m/z") spanning some mass to charge ratio ("m/z") range. Subsequent measurements by the mass spectrometer of unknown species having mass to charge ratio values ("m/z") lying within this range can then be interpolated to obtain accurate values.

However, over a period of time (e.g. over a period of minutes or hours), variations in the environment of the mass spectrometer or analyser (such as variations in the room temperature) can affect the accuracy of the calibration. It is therefore known, during long experiments, to introduce and measure one or more compounds having one or more known mass to charge ratio values ("m/z"), either together with the sample ("internal lock mass"), or by periodically performing short independent acquisitions ("external lock mass"). These measurements are typically used together with the original calibration to correct for any small time dependent drifts.

However, there are situations in which neither the internal lock mass nor the external lock mass approach is satisfactory. For example, in the analysis of living tissue of a patient (e.g. in a surgical environment), the use of an internal lock mass compound may be impossible or unnecessarily risky, since it would involve the introduction of potentially toxic chemicals into the immediate environment of the patient. On the other hand, suspending the experiment for even a short time to acquire an external lock mass spectrum may interfere with timely analysis of the sample in question.

It is therefore desired to provide an improved method of mass and/or ion mobility spectrometry and an improved method of calibration for an analytical instrument.

SUMMARY

According to an aspect there is provided a method of calibrating or optimising an analytical instrument comprising:

analysing analyte from a sample;

determining a sample type of the sample;

identifying one or more species of the analyte that are known to be endogenous to the determined sample type; and calibrating or optimising the analytical instrument using the one or more identified endogenous species.

Various embodiments relate to methods for calibrating or optimising an analytical instrument in which the sample type of a sample being analysed is determined, one or more species that are known to be endogenous to the determined sample type are identified, and wherein the one or more known endogenous species from the sample being analysed are then used to calibrate or optimise the instrument.

According to various embodiments, a list or library of species that are endogenous to each of a set of known sample types is provided and used. According to various embodiments, the sample type of the sample being analysed may be determined, e.g., using known tissue-typing methods based on recent analysis of the sample being analysed. One or more known endogenous species for the determined sample type may then be identified, e.g. using the list or library. Where possible, the instrument is then calibrated or optimised using the identified endogenous species.

Thus, according to various embodiments, the instrument may be calibrated or optimised using knowledge of the possible sample types, together with knowledge of species that will be present in the possible sample types, and post-processing steps.

This then avoids the above described problems with the known internal lock mass and external lock mass approaches, as it is not necessary to introduce or use an internal lock mass compound and there is no need to suspend the experiment in order to calibrate the instrument. The physical complexity of the system is also reduced.

Furthermore, according to various embodiments, by calibrating or optimising the analytical instrument using one or more species that are known to be endogenous to the determined (current) sample type, different species may be used to calibrate or optimise the instrument at different times, e.g., as the sample type of the sample changes or evolves with time. This then provides increased utility and flexibility, and means that the calibration or optimisation according to various embodiments is not simply reliant on, e.g., a single background ion or group of background ions.

Known calibration methods that rely, e.g., on background ions for calibration (such as, for example, U.S. 2009/0065687 (Gross) and WO 2014/194320 (Heaven)) do not perform steps of determining the sample type, nor calibrating or optimising using one or more endogenous species that are identified as being endogenous to the sample type of the sample.

In addition, various embodiments can address various difficulties that can arise with this approach, such as the unpredictability in fluctuations in the abundance of the available calibrant species due to the nature of the experiment and the possibility of interference with other species present.

It will therefore be appreciated that the various embodiments provide an improved method of mass and/or ion mobility spectrometry and an improved method of calibration for an analytical instrument.

The sample may comprise: (i) a living or non-living tissue sample; (ii) a histopathology sample; or (iii) a microbe culture.

The method may comprise ionising the analyte and/or the sample so as to produce a plurality of ions.

The step of ionising the analyte and/or the sample may comprise ionising the analyte and/or the sample using: (i) Rapid Evaporative Ionisation Mass Spectrometry ("REIMS"); and/or (ii) Desorption ElectroSpray Ionisation ("DESI").

The step of ionising the analyte and/or the sample may comprise ionising the analyte and/or the sample using: (i) a rapid evaporative ionisation mass spectrometry ("REIMS") ion source; (ii) a desorption electrospray ionisation ("DESI") ion source; (iii) a laser desorption ionisation ("LDI") ion source; (iv) a thermal desorption ion source; (v) a laser diode thermal desorption ("LDTD") ion source; (vi) a desorption electro-flow focusing ("DEFFI") ion source; (vii) a dielectric barrier discharge ("DBD") plasma ion source; (viii) an Atmospheric Solids Analysis Probe ("ASAP") ion source; (ix) an ultrasonic assisted spray ionisation ion source; (x) an easy ambient sonic-spray ionisation ("EASI") ion source; (xi) a desorption atmospheric pressure photoionisation ("DAPPI") ion source; (xii) a paperspray ("PS") ion source; (xiii) a jet desorption ionisation ("JeDI") ion source; (xiv) a touch spray ("TS") ion source; (xv) a nano-DESI ion source; (xvi) a laser ablation electrospray ("LAESI") ion source; (xvii) a direct analysis in real time ("DART") ion source; (xviii) a probe electrospray ionisation ("PESI") ion source; (xix) a solid-probe assisted electrospray ionisation ("SPA-ESI") ion source; (xx) a cavitron ultrasonic surgical aspirator ("CUSA") device; (xxi) a focussed or unfocussed ultrasonic ablation device; (xxii) a microwave resonance device; or (xxiii) a pulsed plasma RF dissection device.

The step of analysing the analyte from the sample may comprise using the analytical instrument to analyse the analyte from the sample.

The step of analysing the analyte from the sample may comprise measuring one or more physico-chemical properties of the analyte and/or the plurality of ions.

The one or more physico-chemical properties may comprise: (i) mass or mass to charge ratio; (ii) mass or mass to charge ratio peak shape or width; (iii) ion mobility, collision cross section or interaction cross section; and/or (iv) ion mobility, collision cross section or interaction cross section peak shape or width.

The step of determining the sample type of the sample may comprise determining the sample type of the sample based on analysis of analyte from the sample, e.g. based on the analysis of the analyte and/or on prior analysis of analyte from the sample.

The step of determining the sample type may comprise determining the sample type from a plurality of known sample types.

The sample type may comprise: (i) a diseased or non-diseased type of living or non-living tissue; (ii) a diseased or non-diseased type of histopathology sample; or (iii) a diseased or non-diseased type of microbe culture.

The step of identifying one or more species of the analyte that are known to be endogenous to the determined sample type may comprise identifying one or more species of the analyte that are known to be endogenous to the determined sample type based on analysis of analyte from the sample, e.g. based on the analysis of the analyte and/or on prior analysis of analyte from the sample.

The step of identifying one or more species of the analyte that are known to be endogenous to the determined sample type may comprise determining whether one or more species of the analyte correspond to one or more species for the determined sample type that are present in a predetermined list or library.

The predetermined list or library may include one or more species that are endogenous to each of a plurality of known sample types.

The one or more endogenous species may comprise one or more lipids.

The method may comprise using the calibrated or optimised analytical instrument for subsequent analysis of analyte from the sample.

The step of calibrating or optimising the analytical instrument may comprise calibrating or optimising the analytical instrument using one or more measured physico-chemical properties of the one or more identified endogenous species.

The step of calibrating or optimising the analytical instrument may comprise:

generating a calibration for the analytical instrument; and/or updating, modifying and/or correcting an existing calibration for the analytical instrument.

The method may comprise using the generated, updated or modified calibration for subsequent analysis of analyte from the sample.

Updating or modifying the calibration for the analytical instrument may comprise updating or modifying an initial calibration for the analytical instrument.

The step of calibrating or optimising the analytical instrument may comprise optimising one or more operational parameters of the analytical instrument.

The step of identifying one or more species of the analyte that are known to be endogenous to the determined sample type may comprise identifying one or more species of the analyte that are known to be endogenous to the determined sample type and that are sufficiently stable, consistent, abundant and/or isolated in the analyte.

The method may comprise postponing the calibration or optimisation of the analytical instrument when one or more of the known endogenous species cannot be identified or accurately identified.

The method may comprise recording when one or more of the known endogenous species cannot be identified or accurately identified and/or when the calibration or optimisation is postponed.

The method may comprise reducing a confidence or weight assigned to data acquired when one or more of the known endogenous species cannot be identified or accurately identified and/or when the calibration or optimisation is postponed.

The method may comprise while analysing analyte from the sample, repeatedly performing the steps of:

determining the sample type of the sample;

identifying one or more species in the analyte that are known to be endogenous to the determined sample type; and calibrating or optimising the analytical instrument using the one or more identified endogenous species.

According to another aspect there is provided an analytical instrument comprising:

an analyser arranged and adapted to analyse analyte from a sample; and a control system arranged and adapted:

(i) to determine a sample type of the sample;

(ii) to identify one or more species in the analyte that are known to be endogenous to the determined sample type; and (iii) to calibrate or optimise the analytical instrument using the one or more identified endogenous species.

The sample may comprise: (i) a living or non-living tissue sample; (ii) a histopathology sample; or (iii) a microbe culture.

The analytical instrument may comprise an ion source operable to ionise the analyte and/or the sample so as to produce a plurality of ions.

The ion source may comprise: (i) a Rapid Evaporative Ionisation Mass Spectrometry ("REIMS") ion source; and/or (ii) Desorption ElectroSpray Ionisation ("DESI") ion source.

The ion source may comprise: (i) a rapid evaporative ionisation mass spectrometry ("REIMS") ion source; (ii) a desorption electrospray ionisation ("DESI") ion source; (iii) a laser desorption ionisation ("LDI") ion source; (iv) a thermal desorption ion source; (v) a laser diode thermal desorption ("LDTD") ion source; (vi) a desorption electroflow focusing ("DEFFI") ion source; (vii) a dielectric barrier discharge ("DBD") plasma ion source; (viii) an Atmospheric Solids Analysis Probe ("ASAP") ion source; (ix) an ultrasonic assisted spray ionisation ion source; (x) an easy ambient sonic-spray ionisation ("EASI") ion source; (xi) a desorption atmospheric pressure photoionisation ("DAPPI") ion source; (xii) a paperspray ("PS") ion source; (xiii) a jet desorption ionisation ("JeDI") ion source; (xiv) a touch spray ("TS") ion source; (xv) a nano-DESI ion source; (xvi) a laser ablation electrospray ("LAESI") ion source; (xvii) a direct analysis in real time ("DART") ion source; (xviii) a probe electrospray ionisation ("PESI") ion source; (xix) a solid-probe assisted electrospray ionisation ("SPA-ESI") ion source; (xx) a cavitron ultrasonic surgical aspirator ("CUSA") device; (xxi) a focussed or unfocussed ultrasonic ablation device; (xxii) a microwave resonance device; or (xxiii) a pulsed plasma RF dissection device.

The analyser may be configured to analyse analyte from the sample by measuring one or more physico-chemical properties of the analyte and/or the plurality of ions.

The one or more physico-chemical properties may comprise: (i) mass or mass to charge ratio; (ii) mass or mass to charge ratio peak shape or width; (iii) ion mobility, collision cross section or interaction cross section; and/or (iv) ion mobility, collision cross section or interaction cross section peak shape or width.

The control system may be configured to determine the sample type of the sample by determining the sample type of the sample based on analysis of analyte from the sample, e.g. based on the analysis of the analyte and/or on prior analysis of analyte from the sample.

The control system may be configured to determine the sample type by determining the sample type from a plurality of known sample types.

The sample type may comprise: (i) a diseased or non-diseased type of living or non-living tissue; (ii) a diseased or non-diseased type of histopathology sample; or (iii) a diseased or non-diseased type of microbe culture.

The control system may be configured to identify one or more species of the analyte that are known to be endogenous to the determined sample type by identifying one or more species of the analyte that are known to be endogenous to the determined sample type based on analysis of analyte from the sample, e.g. based on the analysis of the analyte and/or on prior analysis of analyte from the sample.

The control system may be configured to identify one or more species of the analyte that are known to be endogenous to the determined sample type by determining whether one or more species of the analyte correspond to one or more species for the determined sample type that are present in a predetermined list or library.

The predetermined list or library may include one or more species that are endogenous to each of a plurality of known sample types.

The one or more endogenous species may comprise one or more lipids.

The calibrated or optimised analytical instrument may be configured to subsequently analyse analyte from the sample.

The control system may be configured to calibrate or optimise the analytical instrument by calibrating or optimising the analytical instrument using one or more measured physico-chemical properties of the one or more identified endogenous species.

The control system may be configured to calibrate or optimise the analytical instrument by:

generating a calibration for the analytical instrument; and/or updating, modifying and/or correcting an existing calibration for the analytical instrument.

The control system may be configured to use the generated, updated or modified calibration for subsequent analysis of analyte from the sample.

The control system may be configured to update or modify the calibration for the analytical instrument by updating or modifying an initial calibration for the analytical instrument.

The control system may be configured to calibrate or optimise the analytical instrument by optimising one or more operational parameters of the analytical instrument.

The control system may be configured to identify one or more species of the analyte that are known to be endogenous to the determined sample type by identifying one or more species of the analyte that are known to be endogenous to the determined sample type and that are sufficiently stable, consistent, abundant and/or isolated in the analyte.

The control system may be configured to postpone the calibration or optimisation of the analytical instrument when one or more of the known endogenous species cannot be identified or accurately identified.

The control system may be configured to record when one or more of the known endogenous species cannot be identified or accurately identified and/or when the calibration or optimisation is postponed.

The control system may be configured to reduce a confidence or weight assigned to data acquired when one or more of the known endogenous species cannot be identified or accurately identified and/or when the calibration or optimisation is postponed.

The analytical instrument may be configured to repeatedly performing the steps, while analysing analyte from the sample, of:

determining the sample type of the sample;

identifying one or more species in the analyte that are known to be endogenous to the determined sample type; and calibrating or optimising the analytical instrument using the one or more identified endogenous species.

According to another aspect there is provided a method comprising:

identifying one or more species endogenous to each of one or more sample types;

determining one or more values of one or more physico-chemical properties for each of the one or more species; and storing the one or more determined values for each of the one or more species together with an indication of the corresponding sample type.

The method may comprise using the stored values to calibrate or optimise an analytical instrument.

According to an aspect there is provided a method of calibrating or optimising an analytical instrument comprising:

analysing analyte from a sample;

identifying one or more species of the analyte that are known to be endogenous to the sample type of the sample; and calibrating or optimising the analytical instrument using the one or more identified endogenous species.

According to an aspect there is provided an analytical instrument comprising:

an analyser arranged and adapted to analyse analyte from a sample; and a control system arranged and adapted:

(i) to identify one or more species in the analyte that are known to be endogenous to the sample type of the sample; and (ii) to calibrate or optimise the analytical instrument using the one or more identified endogenous species.

According to an aspect there is provided a method of operating an analytical instrument comprising:

imaging a sample; and identifying a portion of the sample comprising one or more species that are known to be endogenous to the sample type of the sample; and calibrating or optimising the analytical instrument using the identified portion of the sample.

According to an aspect there is provided an analytical instrument comprising:

a device arranged and adapted to image a sample; and a control system arranged and adapted:

(i) to identify a portion of the sample comprising one or more species that are known to be endogenous to the sample type of the sample; and (ii) to calibrate or optimise the analytical instrument using the identified portion of the sample.

According to another aspect there is provided a method comprising:

identifying and calculating the theoretical mass to charge ratio ("m/z") of one or more selected molecular species endogenous to various types of sample; and storing these values in a library that can be indexed by sample type.

According to another aspect there is provided a method comprising, during an acquisition, iterating the steps of:

(i) updating the current sample type based on analysis of recent data;

(ii) monitoring the measured mass to charge ratio ("m/z") values, peak shapes and/or metadata, and identifying endogenous species corresponding to the current sample type;

(iii) where possible, updating the calibration modification or calibration using some or all of the species identified in recently acquired data; and (iv) applying the current calibration modification to the current data.

The sample may be a living tissue, histopathology sample, or microbe culture, etc.

The method may use an ionisation technique comprising Rapid Evaporative Ionisation Mass Spectrometry ("REIMS"), or Desorption ElectroSpray Ionisation ("DESI"), etc.

The method may comprise optionally calibrating the mass and/or ion mobility spectrometer using a standard calibration mixture prior to commencement of each experiment and initializing a null calibration modification or base calibration.

The spectrometer may comprise an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; (xxviii) a Laser Ablation Electrospray Ionisation ("LAESI") ion source; and (xxix) Surface Assisted Laser Desorption Ionisation ("SALDI").

The spectrometer may comprise one or more continuous or pulsed ion sources.

The spectrometer may comprise one or more ion guides.

The spectrometer may comprise one or more ion mobility separation devices and/or one or more Field Asymmetric Ion Mobility Spectrometer devices.

The spectrometer may comprise one or more ion traps or one or more ion trapping regions.

The spectrometer may comprise one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions;

(xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device.

The spectrometer may comprise a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser.

The spectrometer may comprise one or more energy analysers or electrostatic energy analysers.

The spectrometer may comprise one or more ion detectors.

The spectrometer may comprise one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter.

The spectrometer may comprise a device or ion gate for pulsing ions; and/or a device for converting a substantially continuous ion beam into a pulsed ion beam.

The spectrometer may comprise a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser.

The spectrometer may comprise a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

The spectrometer may comprise a device arranged and adapted to supply an AC or RF voltage to the electrodes. The AC or RF voltage optionally has an amplitude selected from the group consisting of: (i) about <50 V peak to peak; (ii) about 50-100 V peak to peak; (iii) about 100-150 V peak to peak; (iv) about 150-200 V peak to peak; (v) about 200-250 V peak to peak; (vi) about 250-300 V peak to peak; (vii) about 300-350 V peak to peak; (viii) about 350-400 V peak to peak; (ix) about 400-450 V peak to peak; (x) about 450-500 V peak to peak; and (xi)> about 500 V peak to peak.

The AC or RF voltage may have a frequency selected from the group consisting of: (i) < about 100 kHz; (ii) about 100-200 kHz; (iii) about 200-300 kHz; (iv) about 300-400 kHz; (v) about 400-500 kHz; (vi) about 0.5-1.0 MHz; (vii) about 1.0-1.5 MHz; (viii) about 1.5-2.0 MHz; (ix) about 2.0-2.5 MHz; (x) about 2.5-3.0 MHz; (xi) about 3.0-3.5 MHz; (xii) about 3.5-4.0 MHz; (xiii) about 4.0-4.5 MHz; (xiv) about 4.5-5.0 MHz; (xv) about 5.0-5.5 MHz; (xvi) about 5.5-6.0 MHz; (xvii) about 6.0-6.5 MHz; (xviii) about 6.5-7.0 MHz; (xix) about 7.0-7.5 MHz; (xx) about 7.5-8.0 MHz; (xxi) about 8.0-8.5 MHz; (xxii) about 8.5-9.0 MHz; (xxiii) about 9.0-9.5 MHz; (xxiv) about 9.5-10.0 MHz; and (xxv) > about 10.0 MHz.

The spectrometer may comprise a chromatography or other separation device upstream of an ion source. The chromatography separation device may comprise a liquid chromatography or gas chromatography device. Alternatively, the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The ion guide may be maintained at a pressure selected from the group consisting of: (i) < about 0.0001 mbar; (ii) about 0.0001-0.001 mbar; (iii) about 0.001-0.01 mbar; (iv) about 0.01-0.1 mbar; (v) about 0.1-1 mbar; (vi) about 1-10 mbar; (vii) about 10-100 mbar; (viii) about 100-1000 mbar; and (ix) > about 1000 mbar.

Analyte ions may be subjected to Electron Transfer Dissociation ("ETD") fragmentation in an Electron Transfer Dissociation fragmentation device. Analyte ions may be caused to interact with ETD reagent ions within an ion guide or fragmentation device.

Optionally, in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) C60 vapour or atoms; and (viii) magnesium vapour or atoms.

The multiply charged analyte cations or positively charged ions may comprise peptides, polypeptides, proteins or biomolecules.

Optionally, in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenyl-anthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

The process of Electron Transfer Dissociation fragmentation may comprise interacting analyte ions with reagent ions, wherein the reagent ions comprise dicyanobenzene, 4-nitrotoluene or azulene.

A chromatography detector may be provided, wherein the chromatography detector comprises either:

- a destructive chromatography detector optionally selected from the group consisting of (i) a Flame Ionization Detector (FID); (ii) an aerosol-based detector or Nano Quantity Analyte Detector (NQAD); (iii) a Flame Photometric Detector (FPD); (iv) an Atomic-Emission Detector (AED); (v) a Nitrogen Phosphorus Detector (NPD); and (vi) an Evaporative Light Scattering Detector (ELSD); or
- a non-destructive chromatography detector optionally selected from the group consisting of: (i) a fixed or variable wavelength UV detector; (ii) a Thermal Conductivity Detector (TCD); (iii) a fluorescence detector; (iv) an Electron Capture Detector (ECD); (v) a conductivity monitor; (vi) a Photoionization Detector (PID); (vii) a Refractive Index Detector (RID); (viii) a radio flow detector; and (ix) a chiral detector.

The spectrometer may be operated in various modes of operation including a mass spectrometry ("MS") mode of operation; a tandem mass spectrometry ("MS/MS") mode of operation; a mode of operation in which parent or precursor ions are alternatively fragmented or reacted so as to produce fragment or product ions, and not fragmented or reacted or fragmented or reacted to a lesser degree; a Multiple Reaction Monitoring ("MRM") mode of operation; a Data Dependent Analysis ("DDA") mode of operation; a Data Independent Analysis ("DIA") mode of operation a Quantification mode of operation or an Ion Mobility Spectrometry ("IMS") mode of operation.

BRIEF DESCRIPTION OF THE DRAWINGS

Various embodiments will now be described, by way of example only, and with reference to the accompanying drawings in which.

DETAILED DESCRIPTION

Various embodiments relating to methods for calibrating or optimising an analytical instrument, such as a mass and/or ion mobility spectrometer, will now be described.

Figure 1:
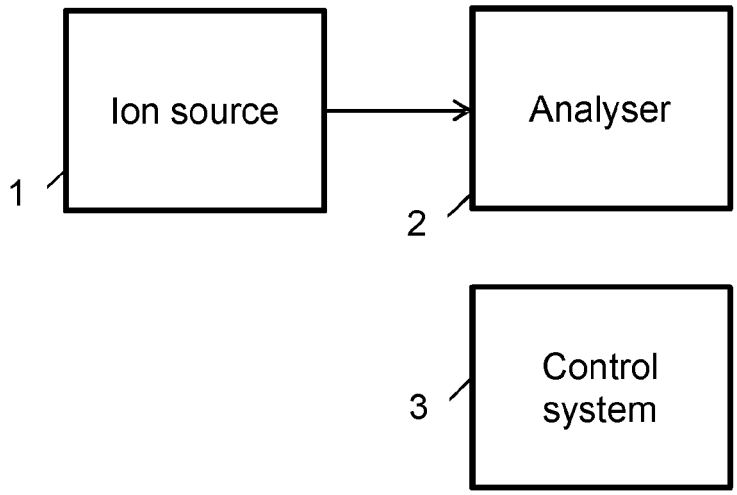
FIG. 1 illustrates schematically an analytical instrument in accordance with various embodiments.

FIG. 1 illustrates an analytical instrument in accordance with various embodiments. As shown in FIG. 1, the analytical instrument may comprise an ion source 1 and an analyser 2 for analysing ions generated by the ion source 1.

The ion source 1 may comprise any suitable ion source, such as a Rapid Evaporative Ionisation Mass Spectrometry ("REIMS") ion source, or a Desorption ElectroSpray Ionisation ("DESI") ion source. Ions generated by the ion source 1 are transferred to the analyser 2 for analysis.

The analyser 2 may comprise any suitable device(s) or stage(s) for analysing analyte ions, e.g. in terms of their mass to charge ratio and/or ion mobility, such as one or more devices for separating ions according to their mass to charge ratio and/or ion mobility, one or more devices for filtering ions according to their mass to charge ratio and/or ion mobility, one or more ion detectors, etc.

The analytical instrument may also comprise a control system 3 that is configured to control the operation of the ion source 1 and the analyser 2, e.g. in the manner of the various embodiments described herein. The control system 3 may comprise suitable control circuitry that is operable to cause the ion source 1 and/or the analyser 2 to operate in the manner of the various embodiments described herein. The control system may also comprise suitable processing circuitry operable to perform any one or more or all of the necessary processing and/or post-processing operations in respect of the various embodiments described herein.

According to various embodiments, endogenous species from a sample being analysed by the analytical instrument are used to correct the instrument calibration. According to various embodiments, the instrument is calibrated or optimised using knowledge of the possible sample types, together with knowledge of species that will be present in the possible sample types, and post-processing steps.

According to various embodiments, a list or library of species that are endogenous to each of a set of known sample types is generated, e.g. prior to analysis of a sample and/or "offline". The set of known sample types may include sample types that are expected based on the particular sample being or to be analysed.

For example, the sample may be a living tissue, a histopathology sample, a microbe culture, etc., and the known sample types may include diseased or non-diseased types of living or non-living tissue (e.g. tissue from different organs, etc.), diseased or non-diseased types of histopathology sample, or diseased or non-diseased types of microbe culture, etc. The endogenous species may comprise, for example, one or more lipids.

The library may be generated by identifying one or more species endogenous to each of one or more sample types, determining one or more values of one or more physicochemical properties for each of the one or more species, and storing the one or more determined values for each of the one or more species together with an indication of the corresponding sample type, e.g. in a suitable memory device or storage medium.

For example, in various embodiments, the theoretical mass to charge ratio ("m/z") of one or more selected molecular species endogenous to various types of sample are identified and/or calculated, and stored in a library that may be indexed by sample type.

According to various embodiments, one or more endogenous species are selected for each of the known sample types for inclusion in the library. This may done, for example, on the basis of the physico-chemical properties (e.g. mass to charge ratio and/or ion mobility) of the species or ions derived from the species. Various criteria for selecting the endogenous molecular species to be used may be considered and used.

For example, species that give rise to ion peaks that are always or very commonly present (e.g. for the particular form of ionisation being used) and that appear at values of the physico-chemical properties that are sufficiently separated or isolated from other peaks (i.e. so as to avoid interferences) and/or that are particularly intense, etc., may be selected and used in the library.

According to various embodiments, when it is desired to analyse a sample, the analytical instrument (e.g. mass and/or ion mobility spectrometer) may optionally be calibrated, e.g. using a standard calibration mixture (e.g. lock mass), prior to commencement of each experiment and a null calibration modification (or base calibration) may be initialized.

According to various embodiments, during an acquisition or analysis of a sample, the following steps may be iterated: (i) the current sample type is updated based on analysis of recent data; (ii) the measured mass to charge ratio ("m/z") values, peak shapes and/or metadata are substantially continuously monitored, and endogenous (molecular) species corresponding to the current sample type are identified; (iii) if possible, the calibration modification (or calibration) is modified or updated using some or all of the species identified in recently acquired data; and (iv) the current calibration modification is applied to the current data.

Thus, according to various embodiments, analyte from a sample, such as a living or non-living tissue sample, a histopathology sample, or a microbe culture, is analysed.

The analyte may comprise an aerosol that may have been generated, e.g., by subjecting the sample to alternating electric current at radiofrequency by, for example, using a surgical diathermy device. This analyte may be transported to the analytical instrument for analysis.

Thus, according to various embodiments, the analytical instrument (e.g. mass and/or ion mobility spectrometer) may comprise or may be coupled to another device, such as a surgical diathermy device. According to various embodiments, the method may comprise the analytical instrument and/or the analyser 2 receiving analyte, e.g. from the other device.

According to various embodiments, the sample, analyte or aerosol may be ionised, e.g. using known Rapid Evaporative Ionisation Mass Spectrometry ("REIMS") techniques.

Figure 2:
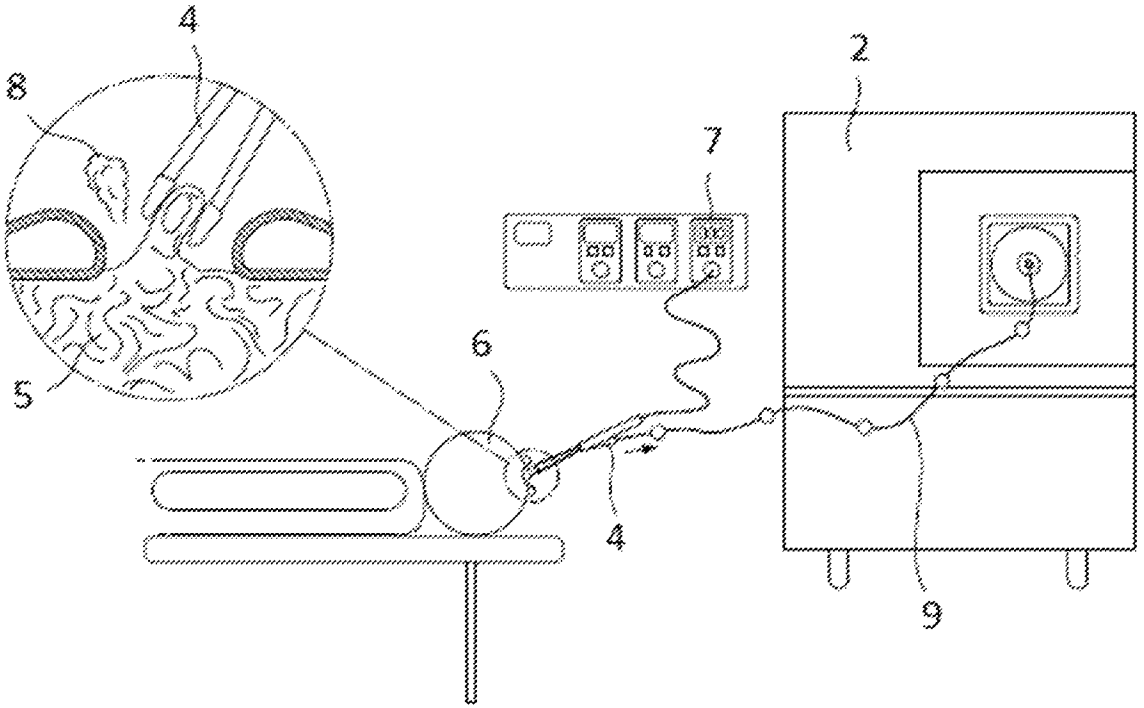
FIG. 2 illustrates schematically the Rapid Evaporative Ionisation Mass Spectrometry ("REIMS") technique according to various embodiments.

FIG. 2 illustrates the Rapid Evaporative Ionisation Mass Spectrometry ("REIMS") technique according to various embodiments.

FIG. 2 illustrates a method of rapid evaporative ionisation mass spectrometry ("REIMS") wherein bipolar forceps 4 may be brought into contact with in vivo tissue 5 of a patient 6. Other arrangements would be possible, such as the use of a surgical diathermy device in place of the bipolar forceps 4.

An RF voltage from an RF voltage generator 7 may be applied to the bipolar forceps (electrodes) 4 which causes localised Joule or diathermy heating of the tissue 5 or sample. As a result, an aerosol or surgical plume 8 is generated. The aerosol or surgical plume 8 may then be captured or otherwise aspirated through an irrigation port of the bipolar forceps 4. The irrigation port of the bipolar forceps 4 may therefore be reutilised as an aspiration port. The aerosol or surgical plume 8 may then be passed from the irrigation (aspiration) port of the bipolar forceps 4 to tubing 9. The tubing 9 is arranged to transfer the aerosol or surgical plume 8 to an atmospheric pressure interface of a mass and/or ion mobility spectrometer 2.

According to various embodiments a matrix comprising an organic solvent such as isopropanol may be added to the aerosol or surgical plume 8 at the atmospheric pressure interface. The mixture of aerosol and organic solvent may then be arranged to impact upon a collision surface within a vacuum chamber of the mass and/or ion mobility spectrometer 2. The collision surface may be heated. The aerosol may be caused to ionise upon impacting the collision surface resulting in the generation of analyte ions. The ionisation efficiency of generating the analyte ions may be improved by the addition of the organic solvent. However, the addition of an organic solvent is not essential.

Analyte ions which are generated by causing the aerosol, smoke or vapour 8 to impact upon the collision surface may then be passed through subsequent stages of the mass and/or ion mobility spectrometer 2 and subjected to analysis such as mass analysis and/or ion mobility analysis in a mass analyser or filter and/or ion mobility analyser.

According to various other embodiments, the sample or analyte may be ionised using Desorption ElectroSpray Ionisation ("DESI").

Figure 3:
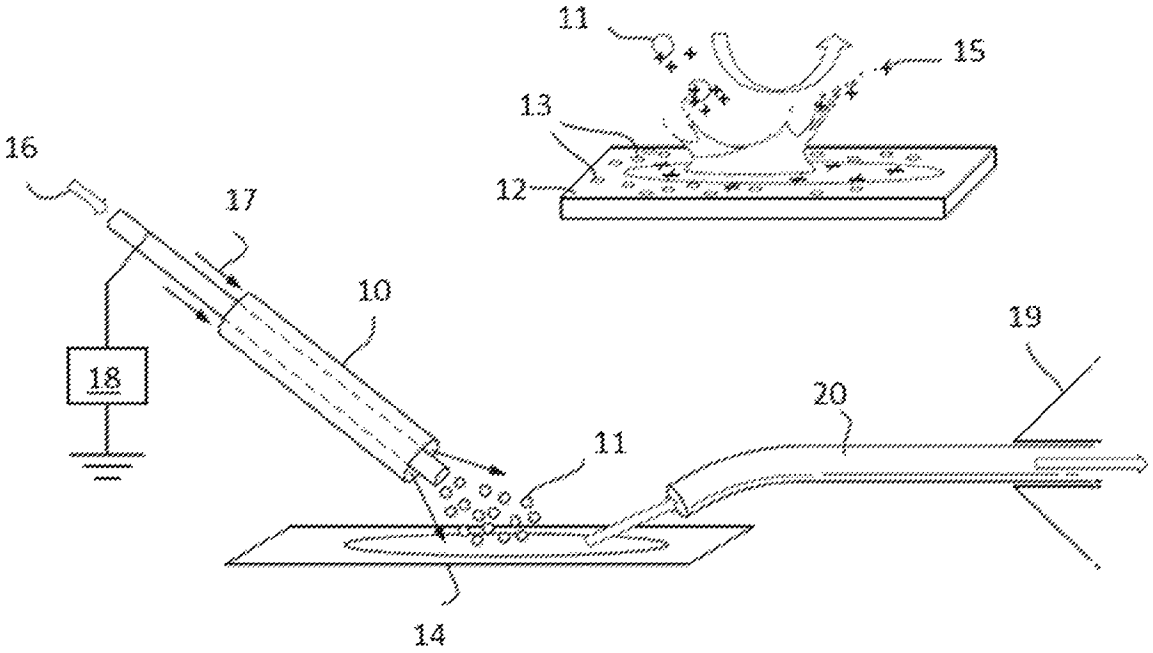
FIG. 3 illustrates schematically the Desorption ElectroSpray Ionisation ("DESI") technique according to various embodiments.

FIG. 3 illustrates the Desorption ElectroSpray Ionisation ("DESI") technique according to various embodiments.

As shown in FIG. 3, the desorption electrospray ionisation ("DESI") technique is an ambient ionisation method that involves directing a spray of (primary) electrically charged droplets 11 onto a surface 12 with analyte 13 present on the surface 12 and/or directly onto a surface of a sample 14. The electrospray mist is pneumatically directed at the sample by a sprayer 10 where subsequent ejected (e.g. splashed) (secondary) droplets 15 carry desorbed ionised analytes (e.g. desorbed lipid ions).

The sprayer 10 may be supplied with a solvent 16, nebulising gas 17 such as nitrogen, and voltage from a high voltage ("HV") source 18. The solvent 16 may be supplied to a central capillary of the sprayer 10, and the nebulising gas 17 may be supplied to a second capillary that may (at least partially) coaxially surround the central capillary. The arrangement of the capillaries, the flow rate of the solvent 16 and/or the flow rate of the gas 17 may be configured such that solvent droplets are ejected from the sprayer 10. The high voltage may be applied to the central capillary, e.g. such that the ejected solvent droplets 11 are charged.

The charged droplets 11 may be directed at the sample such that subsequent ejected (secondary) droplets 15 carry desorbed analyte ions. The ions travel through air into an atmospheric pressure interface 19 of a mass and/or ion mobility spectrometer or analyser (not shown), e.g. via a transfer capillary 20.

The desorption electrospray ionisation ("DESI") technique allows for ambient ionisation of a trace sample at atmospheric pressure with little sample preparation. The desorption electrospray ionisation ("DESI") technique allows, for example, direct analysis of biological compounds such as lipids, metabolites and peptides in their native state without requiring any advance sample preparation.

It would also be possible to use other ionisation techniques. For example, the ion source may comprise (i) a rapid evaporative ionisation mass spectrometry ("REIMS") ion source; (ii) a desorption electrospray ionisation ("DESI") ion source; (iii) a laser desorption ionisation ("LDI") ion source; (iv) a thermal desorption ion source; (v) a laser diode thermal desorption ("LDTD") ion source; (vi) a desorption electro-flow focusing ("DEFFI") ion source; (vii) a dielectric barrier discharge ("DBD") plasma ion source; (viii) an Atmospheric Solids Analysis Probe ("ASAP") ion source; (ix) an ultrasonic assisted spray ionisation ion source; (x) an easy ambient sonic-spray ionisation ("EASI") ion source; (xi) a desorption atmospheric pressure photoionisation ("DAPPI") ion source; (xii) a paperspray ("PS") ion source; (xiii) a jet desorption ionisation ("JeDI") ion source; (xiv) a touch spray ("TS") ion source; (xv) a nano-DESI ion source; (xvi) a laser ablation electrospray ("LAESI") ion source; (xvii) a direct analysis in real time ("DART") ion source; (xviii) a probe electrospray ionisation ("PESI") ion source; (xix) a solid-probe assisted electrospray ionisation ("SPA-ESI") ion source; (xx) a cavitron ultrasonic surgical aspirator ("CUSA") device; (xxi) a focussed or unfocussed ultrasonic ablation device; (xxii) a microwave resonance device; or (xxiii) a pulsed plasma RF dissection device.

According to various embodiments, one or more physico-chemical properties of the analyte or ions derived from the analyte, such as mass or mass to charge ratio, mass or mass to charge ratio peak shape or width, ion mobility, collision cross section or interaction cross section, and/or ion mobility, collision cross section or interaction cross section peak shape or width, are measured (and in various embodiments continuously monitored) by the analytical instrument.

According to various embodiments, the sample type of the sample being analysed is determined e.g. using known tissue-typing methods. According to various embodiments this is done based on recent analysis of the sample being analysed, e.g. based on the analysis of the analyte and/or on prior analysis of analyte from the (same) sample (e.g. by the analytical instrument during the same experimental run, set of experimental runs or surgical procedure), i.e. based on the measured physico-chemical properties of the analyte or ions derived from the analyte.

The "sample type" of the sample may be the identity and/or any phenotypic and/or genotypic characteristic of the sample. For example, the sample type of a human or animal tissue sample may be the type of the tissue, e.g., liver, kidney, or lung. Alternatively or in addition, it may be the disease state of the sample, e.g., healthy or cancerous. The sample type of a microbial sample may, e.g. be information about the genus, species, and/or strain of a microbe present in the sample.

The determination of the sample type may involve using a device to generate aerosol, smoke or vapour from the sample, mass and/or ion mobility analysing said aerosol, smoke, or vapour, or ions derived therefrom so as to obtain spectrometric data, and analysing said spectrometric data. The method may comprise analysing analyte ions derived from the aerosol, smoke or vapour. Analysing the spectrometric data may comprise analysing one or more sample spectra so as to classify an aerosol, smoke or vapour sample. This may comprise developing a classification model or library using one or more reference sample spectra, or may comprise using an existing library. For example, an identification of the sample type may be made if the spectrometric data corresponds more closely to one library entry than any other library entry. Analysing the one or more sample spectra so as to classify the aerosol, smoke or vapour sample may comprise unsupervised analysis of the one or more sample spectra (e.g., for dimensionality reduction) and/or supervised analysis of the one or more sample spectra (e.g., for classification). An exemplary method for tissue-typing using spectrometric analysis is disclosed in Balog et al. Science Translational Medicine 17 Jul. 2013, vol 5, issue 194, 194ra93.

One or more known endogenous species for the determined sample type are then identified, e.g. using the list or library. That is, one or more species of the analyte that are known to be endogenous to the determined sample type are identified, e.g. based on the analysis of the analyte and/or on prior analysis of analyte from the sample.

This may be done by determining whether one or more species of the analyte correspond to one or more species for the determined sample type that are present in the predetermined list or library. An appropriate window or error may be used in this determination, in order to account for instrument drifts.

According to various embodiments, where possible, the instrument is then calibrated or optimised using the identified endogenous species, i.e. using the measured physico-chemical properties of the identified endogenous species.

A new calibration may be generated for the analytical instrument, and/or an existing or current calibration (e.g. the initial calibration or a subsequent calibration) may be updated, modified and/or corrected.

The calibration type may include a polynomial, spline or probabilistic calibration.

According to various embodiments, the step of calibrating the instrument or modifying a or the calibration may comprise: (i) modifying one or more calibration parameters (e.g. polynomial coefficients, gain, etc.); (ii) modifying an underlying base or initial calibration; and/or (iii) applying an extra calibration (which may be subject to some constraints, e.g. polynomial order) after the main or initial calibration.

The calibration may be an absolute calibration or a relative calibration, e.g. relative to an initial calibration made at the beginning of an experiment.

Additionally or alternatively, one or more operational parameters of the analytical instrument may be optimised using the identified endogenous species, i.e. using the measured physico-chemical properties of the identified endogenous species. According to various embodiments, in a feedback mode of operation, the data corresponding to the identified molecular species may be used to guide modification of one or more instrument parameters to improve data quality.

The parameter(s) that are optimised may include, for example, one or more voltages (e.g. detector voltage), one or more temperatures, one or more gas pressures, one or more flow rates, etc., of the instrument. The parameter(s) that are optimised may include one or more parameters of the ion source 1 and/or one or more parameters of the analyser 2.

For example, where the ion source 1 comprises a Rapid Evaporative Ionisation Mass Spectrometry ("REIMS") ion source, the parameter(s) that are optimised may include, for example, the amplitude and/or frequency of the RF voltage applied to the electrodes 4, the composition, temperature and/or flow rate of the solvent, the temperature of the heated collision surface, the position and/or orientation of the electrodes 4, etc.

Where the ion source 1 comprises a Desorption Electro-Spray Ionisation ("DESI") ion source, the parameter(s) that are optimised may include, for example, the composition, flow rate and/or temperature of the solvent 16, the composition, flow rate and/or temperature of the nebulising gas 17, the magnitude of the high voltage, the position and/or orientation of the sprayer 10 and/or the capillary 20, etc.

The calibrated or optimised analytical instrument is in various embodiments then used for subsequent analysis of analyte from the sample and/or the calibration is applied to the current data.

According to various embodiments, the steps for calibrating or optimising the instrument (i.e. determining the sample type and identifying known endogenous species, etc.) may be iterated, e.g. periodically, at predetermined time intervals, or after a predetermined number of experiments. According to various embodiments, as the composition of the sample (potentially) changes, e.g. between different sample types, then the determined sample type and corresponding known endogenous species used for the calibration can also change. This ensures that an optimum calibration is maintained as the sample type changes.

For example, where the ion source 1 is scanned (e.g. in a raster pattern) across the surface of the target or sample (and/or where the sample is scanned relative to the ion source 1), then as the composition of the sample changes between different positions on the sample, e.g. from sample type to different sample type, then the determined sample type and the corresponding known endogenous species that are selected and used for the calibration may change.

Additionally or alternatively, where the composition of the sample changes as the sample is "consumed" due to the ionisation process or otherwise, then the determined sample type and corresponding known endogenous species that are selected and used for the calibration may change. For example, as a sample is consumed when using the REIMS technique, e.g. during a surgical procedure, the sample type may change e.g. from a diseased tissue to a non-diseased tissue, and so the determined sample type and corresponding known endogenous species that are selected and used for the calibration may also change in order to ensure that an optimum calibration is maintained.

According to various embodiments, the calibration or optimisation of the analytical instrument may be postponed when one or more of the known endogenous species, i.e. present in the list or library, cannot be identified or accurately identified.

According to various embodiments, the system may be configured such that the calibration modification is updated only once a sufficient number of ions have been measured or acquired, i.e. such that adequate statistics may be produced for the calibration.

For example, a number of recently acquired spectra may be summed, e.g. over a time period shorter than the characteristic timescale of the expected calibration drift for this purpose. According to various embodiments, the minimum number of spectra necessary for adequate statistics may be summed for this purpose, so as to reduce any problems associated with instrument drifts.

According to various embodiments, the calibration or optimisation may be postponed where the one or more identified species are not sufficiently stable, consistent, abundant, clear and/or isolated in the measurement. Additionally or alternatively, species that are not sufficiently stable, consistent, abundant, clear and/or isolated in the measurement may be (temporarily) removed from consideration for the calibration (and other species may be relied on where present).

For example, if for one or more given species, unexpected rapid changes in the measured mass to charge ratio ("m/z") and/or changes in the peak shape are observed, which, e.g., may be due to interference from other species present in the sample, then these one or more species may temporarily be removed from consideration.

According to various embodiments, the calibration or optimisation may be postponed where metadata, such as information regarding detector saturation and/or instrument warning states, indicates that the acquired data is not sufficiently reliable for the calibration.

According to various embodiments, in any such cases where acceptable reference measurements are unavailable and/or the calibration is postponed, the most recent "good" calibration modification (or calibration) or optimisation may be retained and used, e.g. until a new calibration optimisation is produced.

When the calibration is postponed, a record may be made, and the confidence or weight assigned to data acquired during this time can be reduced. For example, if some predetermined maximum time has elapsed since the last "good" modification (or calibration) was obtained, a mass accuracy warning flag may be set. Inferences regarding the composition of the current sample may be modulated in light of this information.

According to various embodiments, diagnostic information obtained from the calibration procedure, e.g. evidence (marginal likelihood), curvature or residuals, may be used to enable automatic selection of a high quality subset of data for use at any particular time during the analysis.

Although the above embodiments have been described primarily in terms of mass to charge ratio ("m/z") calibration, according to various other embodiments, the same techniques may be used in ion mobility, collision cross section ("CCS") or interaction cross section calibration i.e. in internal lock CCS. Ion mobility or collisional cross section ("CCS") calibrations may be updated in real-time based on measurement of endogenous species.

Aspects of the above described embodiments may also be applied to ion imaging techniques, such as Desorption Electrospray Ionisation ("DESI") or Matrix-Assisted Laser Desorption/Ionisation ("MALDI") imaging techniques. It should be understood that as used herein, the terms "image", "imaging" or similar relate to any type of spatial profiling of a sample surface, i.e. where spatially resolved data is acquired for a sample surface (and that, for example, in these embodiments, an "image" need not be displayed or otherwise formed).

According to a known imaging technique, a lock mass sample is provided on or together with the two-dimensional sample to be imaged. For example, a lock mass patch may be provided in one corner of a tissue section sample. While imaging the sample by raster scanning across the sample, a periodic lock mass calibration may be acquired by periodically returning to and analysing the lock mass patch.

According to various embodiments, when imaging a sample (e.g. a two dimensional sample such as a tissue section sample), the analytical instrument (e.g. mass and/or ion mobility spectrometer) may be calibrated or optimised using a portion of the sample that has been determined to be particularly useful for the calibration or optimisation, e.g. for which one or more of the known endogenous species or particularly useful known endogenous species (e.g. as described above) are present. The calibration may be performed by (e.g. repeatedly and/or periodically) returning to and analysing the identified particular portion of the sample. This then means that no lock mass patch is required (and according to various embodiments, no lock mass patch is provided).

Thus, according to various embodiments, the method comprises imaging a sample, identifying a part of the sample that comprises one or more species that are known to be endogenous to the sample type of the sample, and calibrating or optimising the analytical instrument using the identified part of the sample.

According to various embodiments, imaging the sample comprises analysing the sample, optionally by ionising the sample, optionally by (raster) scanning across the sample.

According to various embodiments, identifying a part of the sample that comprises one or more species that are known to be endogenous to the sample type of the sample may comprise identifying a part of the sample that comprises one or more species that are known to be endogenous to the sample type of the sample and that are particularly useful for the calibration or optimisation.

According to various embodiments, a portion of the sample may be determined to be particularly useful for calibration where one or more known endogenous species (e.g. as described above) are present and/or where one or more selected endogenous species are present, such as one or more known endogenous species that are sufficiently or particularly stable, consistent, abundant, intense, clear and/or isolated (e.g. as described above).

According to various embodiments, calibrating or optimising the analytical instrument using the identified portion of the sample may comprise calibrating or optimising the analytical instrument using the known endogenous species present in the identified portion of the sample (e.g. as described above).

According to various embodiments, the sample type of the sample may be determined (e.g. as described above) during the imaging experiment.

According to various embodiments, the particular portion of the sample that is used for the calibration may be changed or updated e.g. when an improved portion is discovered during the imaging experiment.

Although the present invention has been described with reference to preferred embodiments, it will be understood by those skilled in the art that various changes in form and detail may be made without departing from the scope of the invention as set forth in the accompanying claims.

The invention claimed is:

1. A method of calibrating or optimising an analytical instrument comprising:

analysing analyte from a sample using an analytical instrument by measuring one or more physico-chemical properties of said analyte;

determining a sample type of said sample based on one or more measured physico-chemical properties of analyte from said sample, wherein:

said sample type is one or more of: (a) a phenotypic characteristic, (b) a genotypic characteristic, and/or (c) a disease state of said sample, or said sample is a microbial sample and said sample type is one or more of: (A) information about the genus, (B) information about the species, and/or (C) information about a strain of a microbe present in said sample;

identifying one or more species of said analyte that are known to be endogenous to said determined sample type; and calibrating or optimising said analytical instrument using one or more measured physico-chemical properties of said one or more identified endogenous species;

wherein said step of identifying one or more species of said analyte that are known to be endogenous to said determined sample type comprises determining whether one or more species of said analyte correspond to one or more species for said determined sample type that are present in a predetermined list or library, wherein said predetermined list or library includes one or more selected species that are endogenous to each of a plurality of known sample types.

2. A method as claimed in claim 1, wherein said sample comprises: (i) a living or non-living tissue sample; (ii) a histopathology sample; or (iii) a microbe culture.

3. A method as claimed in claim 1, further comprising ionising said analyte and/or said sample using: (i) Rapid Evaporative Ionisation Mass Spectrometry ("REIMS"); and/or (ii) Desorption ElectroSpray Ionisation ("DESI") so as to produce a plurality of ions.

4. A method as claimed in claim 1, wherein said step of analysing said analyte from said sample comprises measuring one or more physico-chemical properties of said analyte and/or said plurality of ions, wherein said one or more physico-chemical properties comprise: (i) mass or mass to charge ratio; (ii) mass or mass to charge ratio peak shape or width; (iii) ion mobility, collision cross section or interaction cross section; and/or (iv) ion mobility, collision cross section or interaction cross section peak shape or width.

5. A method as claimed in claim 1, wherein said step of determining said sample type of said sample comprises determining said sample type of said sample based on said analysis of said analyte and/or on prior analysis of analyte from said sample.

6. A method as claimed in claim 1, wherein said step of determining said sample type comprises determining said sample type from a plurality of known sample types.

7. A method as claimed in claim 1, wherein said sample type comprises: (i) a diseased or non-diseased type of living or non-living tissue; (ii) a diseased or non-diseased type of histopathology sample; or (iii) a diseased or non-diseased type of microbe culture.

8. A method as claimed in claim 1, wherein said step of identifying one or more species of said analyte that are known to be endogenous to said determined sample type comprises identifying one or more species of said analyte that are known to be endogenous to said determined sample type based on said analysis of said analyte and/or on prior analysis of analyte from said sample.

9. A method as claimed in claim 1, wherein said one or more endogenous species comprise one or more lipids.

10. A method as claimed in claim 1, further comprising using said calibrated or optimised analytical instrument for subsequent analysis of analyte from said sample.

11. A method as claimed in claim 1, wherein said step of calibrating or optimising said analytical instrument comprises:

generating a calibration for said analytical instrument; and/or updating, modifying and/or correcting an existing calibration for said analytical instrument; and/or optimising one or more operational parameters of said analytical instrument.

12. A method as claimed in claim 1, wherein said step of identifying one or more species of said analyte that are known to be endogenous to said determined sample type comprises identifying one or more species of said analyte that are known to be endogenous to said determined sample type and that are sufficiently stable, consistent, abundant, clear and/or isolated.

13. A method as claimed in claim 1, further comprising postponing said calibration or optimisation of said analytical instrument when one or more of said known endogenous species cannot be identified or accurately identified.

14. A method as claimed in claim 13, further comprising recording when one or more of said known endogenous species cannot be identified or accurately identified and/or when said calibration or optimisation is postponed.

15. A method as claimed in claim 13, further comprising reducing a confidence or weight assigned to data acquired when one or more of said known endogenous species cannot be identified or accurately identified and/or when said calibration or optimisation is postponed.

16. A method as claimed in claim 1, comprising while analysing analyte from said sample, repeatedly performing said steps of:

determining said sample type of said sample;

identifying one or more species in said analyte that are known to be endogenous to said determined sample type; and calibrating or optimising said analytical instrument using said one or more identified endogenous species.

17. An analytical instrument comprising:

an analyser arranged and adapted to analyse analyte from a sample by measuring one or more physico-chemical properties of said analyte; and a control system arranged and adapted:

(i) to determine a sample type of said sample based on one or more measured physico-chemical properties of analyte from said sample, wherein:

said sample type is one or more of: (a) a phenotypic characteristic, (b) a genotypic characteristic, and/or (c) a disease state of said sample; or wherein said sample is a microbial sample and said sample type is one or more of: (A) information about the genus, (B) information about the species, and/or (C) information about a strain of a microbe present in said sample;

(ii) to identify one or more species in said analyte that are known to be endogenous to said determined sample type by determining whether one or more species of said analyte correspond to one or more species for said determined sample type that are present in a predetermined list or library, wherein said predetermined list or library includes one or more selected species that are endogenous to each of a plurality of known sample types; and (iii) to calibrate or optimise said analytical instrument using one or more measured physico-chemical properties of said one or more identified endogenous species.

18. A method comprising:

identifying one or more species endogenous to each of one or more sample types;

determining one or more values of one or more physico-chemical properties for each of said one or more species; and storing said one or more determined values for each of said one or more species together with an indication of the corresponding sample type.

* * * * *